United States Patent [19]

Gilbert

[11] 3,943,815

[45] Mar. 16, 1976

[54] ILLUMINATED GUITAR

[75] Inventor: Clifford W. Gilbert, Flint, Mich.

[73] Assignee: Gilbert Guitars, Inc., Flint, Mich.

[22] Filed: Nov. 4, 1974

[21] Appl. No.: 520,557

[52] U.S. Cl. ..... 84/293; 84/267; 84/314; 84/464; 84/DIG. 30; 240/2 L; 240/10 R

[51] Int. Cl.[2]... G10D 1/00; G10D 1/08; G10D 3/06

[58] Field of Search..... 84/1.16, 1.18, 267–269, 84/293, 314, 464, 470, 477 R, 485, DIG. 30; 240/2 L, 10 R

[56] References Cited

UNITED STATES PATENTS

| | | | |
|---|---|---|---|
| 1,669,117 | 5/1928 | Beers | 84/464 |
| 1,913,,233 | 6/1933 | DeFrancesco | 84/464 |
| 3,324,755 | 6/1967 | Canonico | 84/267 |
| 3,403,591 | 10/1968 | Weitzner | 84/485 |
| 3,733,953 | 5/1973 | Ferber | 84/1.16 |
| 3,800,058 | 3/1974 | Bartok et al. | 84/1.18 |
| 3,854,370 | 12/1974 | Sapinski | 84/485 |

*Primary Examiner*—L. T. Hix
*Assistant Examiner*—Stanley J. Witkowski
*Attorney, Agent, or Firm*—Krass & Young

[57] ABSTRACT

A guitar containing fiber optic strands extending through the neck to conduct light from a source located in the body to fret markers on the fretted surface of the neck and the side surface facing the guitarist, thereby allowing the instrument to be played in the dark and producing a pleasing aesthetic affect.

10 Claims, 4 Drawing Figures

ILLUMINATED GUITAR

BACKGROUND OF THE INVENTION

1. Field of the Invention

This invention relates to illuminated guitars and specifically to guitars having illuminated fret markers.

2. Objects of the Invention

It is the object of the present invention to provide a guitar having an illuminated neck which allows the guitar to be played in a dark or dim surrounding and also enhances the aesthetic appearance of the guitar without at the same time appreciably adding to its cost.

SUMMARY OF THE INVENTION

The present invention broadly takes the form of a guitar having a light source located within a hollowed-out portion in the rear of the body and connected to a power source which may be external or of the portable battery type. A bundle of fiber optic strands are disposed within the neck extending from the light source to each of the individual fret markers, thereby illuminating the fret markers when the light is on. Some of the fiber strands also terminate on one side of the neck at positions adjacent the fret markers so as to be visible to the guitarist. This allows the guitar to be played in a dark or dim surrounding and also enhances the aesthetic appeal of the guitar as well.

Other objectives, advantages, and applications of the invention will be made apparent by the following detailed description of the preferred embodiment of the invention. The description makes reference to the accompanying drawings in which.

Figure 1:
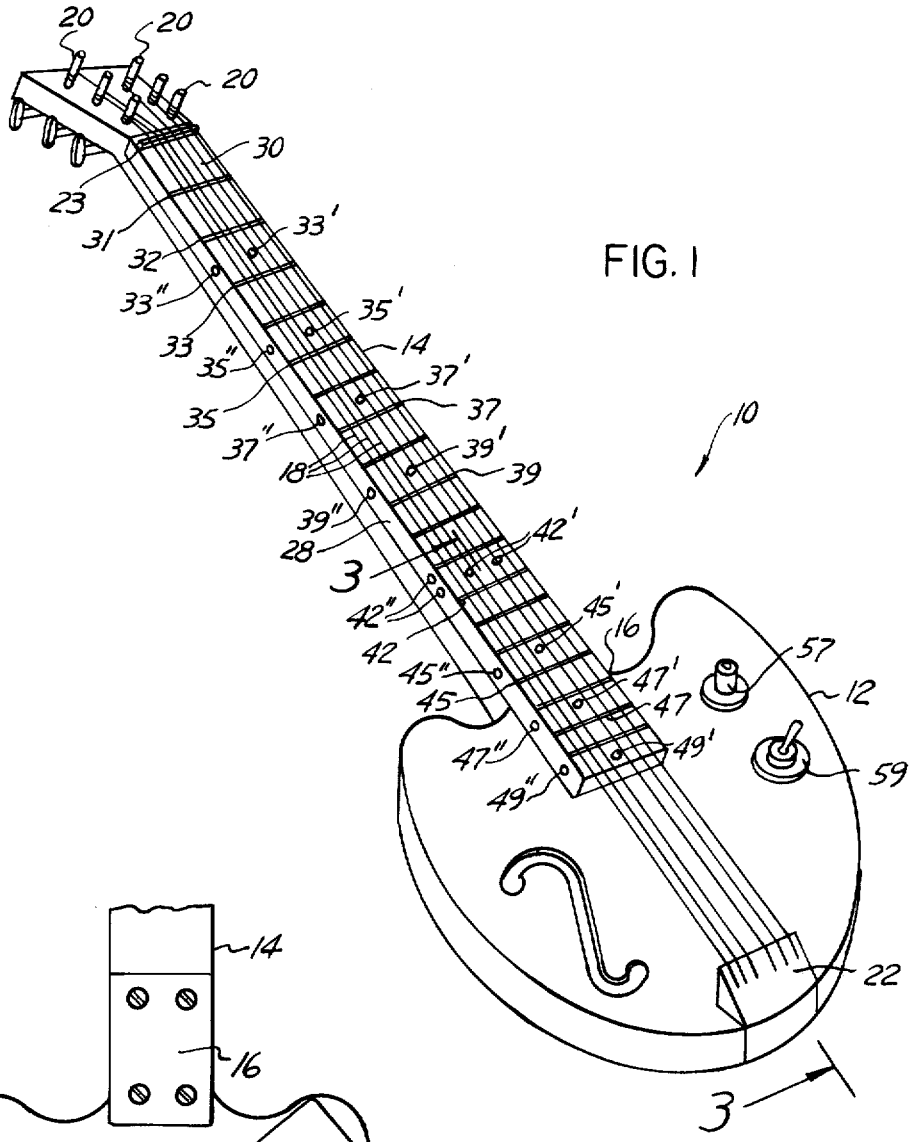
FIG. 1 is a perspective view of a guitar.
Figure 2:
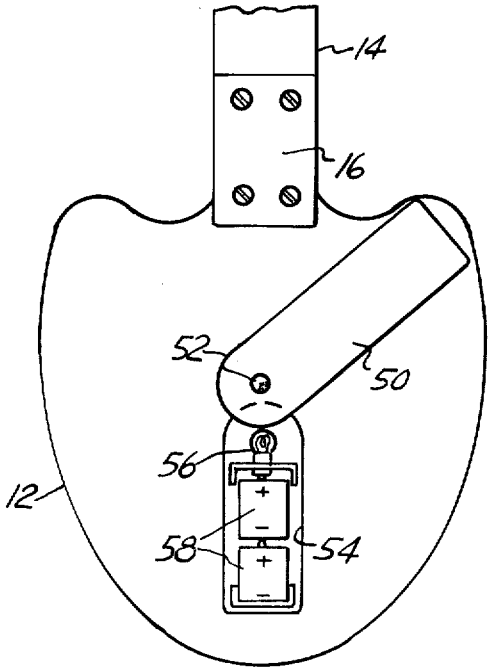
FIG. 2 is a rear view of the body of the guitar of FIG. 1.
Figure 3:
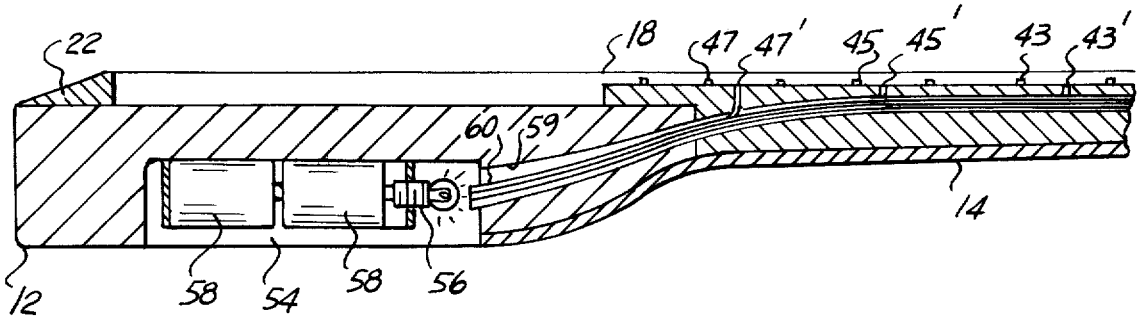
FIG. 3 is a cross-sectional view of the guitar of FIG. 1 taken along line 3—3.

The present invention broadly comprises a guitar 10 having a body 12 and an elongated neck 14 extending therefrom and fastened to the body at 16. The body 12 of the guitar 10, as depicted in FIGS. 1–3, is shown as having a solid construction, as opposed to the hollow-bodied type commonly found on most acoustic guitars. The body is illustrated in this manner only because it is anticipated that the primary use of the present invention will be in conjunction with electric guitars, which generally have solid bodies. There is, however, no functional reason why a hollow-bodied guitar could not also be used.

The guitar 10 has strings 18 which extend substantially its entire length from pegs 20 at the top of the neck 14 over a bridge 23 to a tail piece 22 located at the base of the body 12. The guitar illustrated in FIG. 1 is shown as having a standard set of six strings, individually referred to as the E, A, D, G, B and High E strings.

The fact that the guitar has six strings, however, is not essential to the invention. A 12-string guitar, a 4-string bass, or even a banjo or ukulele could be substituted equally as well. As previously stated, the standard 6-string electrical guitar is shown because the present invention is directed primarily for use in conjunction with such an instrument.

Set in the substantially flat surface 30 of the neck 14 of the guitar 10 are a plurality of frets 33, 35 and 37 being representative thereof, transversely disposed at predetermined locations along its length. As will be apparent to those of ordinary skill in the music art, the frets allow the guitarist to produce a variety of different notes from the same string by reducing the effective length of the string when the string is depressed against one of the frets. Thus, the location of the frets along the neck 14 is determined by the change in the length of a string required for that string to produce the next higher half note. Thus, as can be seen, if the E-string is depressed against fret 31, the musical note produced when the string is played is an F. Similarly, the notes produced by playing the E-string when it is depressed against frets 32 and 33 are F sharp/G flat and G, respectively. A similar analysis obtains for the other five strings as well.

Disposed on the fretted surface 30 of the neck 14, between predetermined frets, are fret indicators, or fret markers, 33′, 35′ and 37′ being representative thereof. These markers commonly appear adjacent the third 33, fifth 35, seventh 37, ninth 39, 12th 42, 15th 45, 17th 47, and 19th 49 frets, and are intended to aid the guitarist in properly positioning his left hand at the desired fret along the neck 14 of the guitar 10. A double fret marker 42′ usually appears adjacent the 12th fret 42 indicating the next higher octave; e.g., the high E-string depressed against the 12th fret 42 corresponds to the next higher E, and so on.

A similar set of fret markers, 33″, 35″ and 37″ being indicative thereof, also appear on the side surface 28 of the neck 14 at locations corresponding to the markers on the fretted surface 30, as shown in FIG. 1. The side surface 28 also contains a double fret marker 42″ indicating the location of the twelfth fret 42.

Referring to FIG. 2, the backside of the body 12 of the guitar 10 has a hollowed-out portion 54 which contains a light source 56 electrically connected to a power source comprised of a pair of batteries 58. A flap 50, hinged at 52, is provided to cover the opening 54 so as to confine the light source 56 within the body 12 and to improve the appearance of the backside of the guitar 10. A switch 59 located on the body 12 controls the on/off condition of the light source 56.

The power source need not be internally located as shown, but may be an external source (e.g. wall outlet) which connects through a plug to a jack 57 located on the body 12. The light source 56 would then, of course, be electrically connected to the jack 57, rather than to the batteries 58, as illustrated in FIG. 2.

It should also be noted that the light source 56 need not be located in the body 12 either, but alternatively, may be disposed within a hollowed-out portion on the backside of the neck 14, for example, or any other location within the guitar which will physically accommodate the light source 56. The backside of the body 12 has been selected as the preferred location because it provides easy access and the opening 54 is readily concealable.

Figure 4:
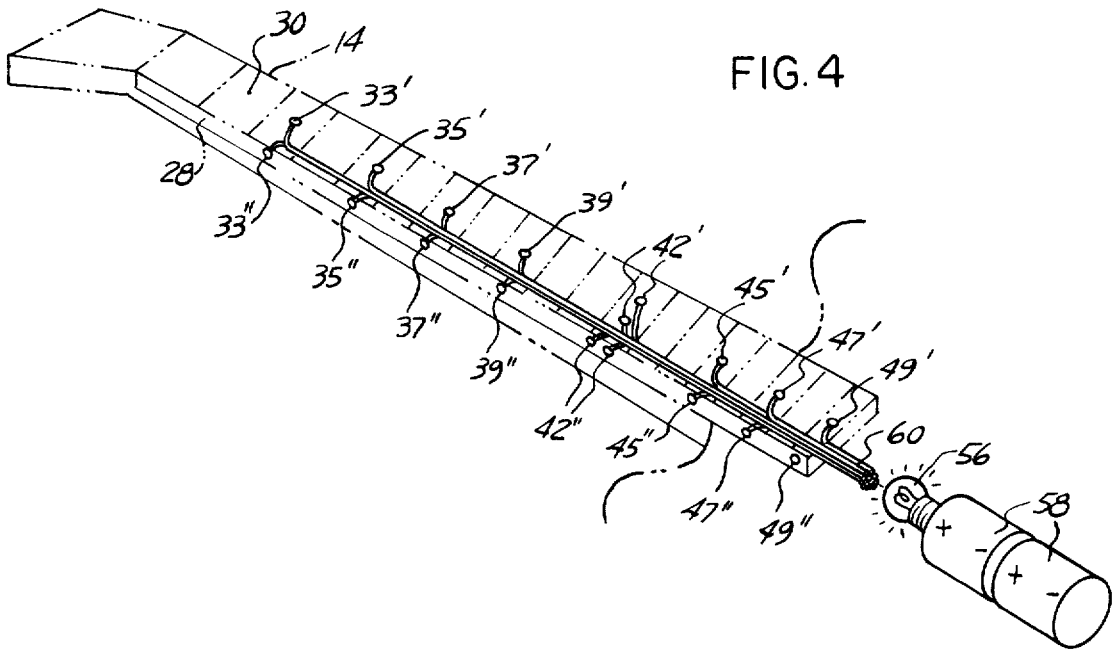
FIG. 4 is a transparent view of the neck of the guitar showing the orientation of the fiber optic strands.

A longitudinal channel or tunnel 59 is formed through the body and neck of the guitar, as shown in FIG. 3, originating at the hollowed-out portion 54 in the body 12 and extending through the neck 14 to within the proximity of the third fret 43. Small holes are drilled into the neck 14 from each of the fret markers to the tunnel 59. A bundle of optically conductive strands 60, commonly referred to as fiber optics, are disposed within the tunnel 59. The bundle 60 contains one strand for each fret marker appearing on the fretted surface 30 and side 28 surfaces of the neck 14. The fiber optic strands 60, as shown in FIG. 4, extend from the light source 56 at the mouth of the tunnel 59 to each of the individual fret markers disposed on the neck 14 of the guitar. Thus, as will be apparent to those of ordinary skill in the fiber optic art, when the light source 56 is on, the light emitted therefrom will be conducted through each of the strands 60 and emitted out their opposite ends, thereby giving the fret markers an illuminated appearance. This illuminated effect allows the guitar 10 to be played in a dark or dim surrounding by assisting the guitarist in locating the desired frets along the neck 14 of the guitar 10.

In summary, a guitar is disclosed which contains means for illuminating the fret markers on the neck, allowing the guitar to be played in a dark or dim surrounding and at the same time adding to the aesthetic appeal of the guitar without significantly increasing its cost or affecting its musical quality.

Having thus described my invention, I claim:

1. A stringed instrument comprising a body, an optically opaque neck having a fretted surface, a light source disposed within said instrument, and at least one optically conductive strand disposed within said instrument and extending from said light source to a predetermined location on the fretted surface of said neck to provide a point of light on said opaque neck.

2. The stringed instrument of claim 1 wherein said fretted surface contains at least one fret marker defining said predetermined location on said fretted surface of said neck.

3. The stringed instrument of claim 2 wherein said fretted surface contains a plurality of fret markers disposed at predetermined locations on said fretted surface.

4. The stringed instrument of claim 3 including a plurality of optically conductive strands extending from said light source to each of said fret markers on said fretted surface to illuminate said markers on said opaque neck.

5. The stringed instrument of claim 1 wherein said light source is disposed within the body of said instrument.

6. The stringed instrument of claim 5 including an electrical power source disposed within said body and electrically connected to said light source.

7. A stringed instrument comprising an opaque body, a neck having a fretted surface and a side surface adjacent said fretted surface, a light source disposed within said instrument, and at least one optically conductive strand disposed within said neck and extending from said light source to a predetermined location on said side surface of said neck.

8. The stringed instrument of claim 7 wherein said side surface contains at least one fret marker defining said predetermined location on said side surface of said neck.

9. The stringed instrument of claim 8 wherein said side surface contains a plurality of fret markers disposed at predetermined locations on said side surface of said neck.

10. The stringed instrument of claim 9 including a plurality of optically conductive strands extending from said light source to each of said fret markers on said side surface of said neck.

* * * * *

UNITED STATES PATENT OFFICE

CERTIFICATE OF CORRECTION

Patent No. 3,943,815 Dated March 16, 1976

Inventor(s) Clifford W. Gilbert

It is certified that error appears in the above-identified patent and that said Letters Patent are hereby corrected as shown below:

Column 2, line 27 "E" should be --B--;
Column 4, lines 14 and 15 "A stringed instrument comprising an opaque body, a neck" should be --A stringed instrument comprising a body, an opaque neck--.

Signed and Sealed this

*twenty-ninth* Day of *June 1976*

[SEAL]

*Attest:*

RUTH C. MASON
*Attesting Officer*

C. MARSHALL DANN
*Commissioner of Patents and Trademarks*